United States Patent [19]

Odagiri et al.

[11] Patent Number: 4,863,355

[45] Date of Patent: Sep. 5, 1989

[54] AIR COMPRESSOR HAVING CONTROL MEANS TO SELECT A CONTINUOUS OR INTERMITTENT OPERATION MODE

[75] Inventors: Akiharu Odagiri; Michinobu Setoyama, both of Kanagawa, Japan

[73] Assignee: Tokico Ltd., Kanagawa, Japan

[21] Appl. No.: 161,129

[22] Filed: Feb. 26, 1988

[30] Foreign Application Priority Data

Mar. 20, 1987 [JP] Japan ..... 62-67115
Mar. 20, 1987 [JP] Japan ..... 62-67116

[51] Int. Cl.[4] ..... F04B 49/02

[52] U.S. Cl. ..... 417/12; 417/28; 417/44; 417/290

[58] Field of Search ..... 417/12, 44, 53, 280, 417/290, 295, 298, 26, 28, 317

[56] References Cited

U.S. PATENT DOCUMENTS

| | | | |
|---|---|---|---|
| 1,756,701 | 4/1930 | Riesner | 417/317 |
| 1,936,411 | 11/1933 | Schneider | 417/280 |
| 2,516,291 | 7/1950 | Bartholomew | 417/44 |
| 3,602,610 | 8/1971 | Bloom | 417/12 |
| 3,860,363 | 1/1975 | Silvern et al. | 417/12 |
| 3,961,862 | 6/1976 | Edstrom et al. | 417/295 X |
| 4,135,860 | 1/1979 | Van Nederkassel | 417/12 |
| 4,149,827 | 4/1979 | Hofmann, Jr. | 417/53 X |

FOREIGN PATENT DOCUMENTS 59-158392 9/1984 Japan .
59-148491 10/1984 Japan .

*Primary Examiner*—Carlton R. Croyle
*Assistant Examiner*—Leonard P. Walnoha
*Attorney, Agent, or Firm*—Wenderoth, Lind & Ponack

[57] ABSTRACT

An air compressor is controlled such that when the pressure inside a tank for storing compressed air reaches a predetermined lower-limit value, the compressor is brought into a load running state to supply compressed air to the tank, whereas, when the pressure inside the tank reaches a predetermined upper-limit value, the compressor is brought into a stand-by state to suspend the supply of compressed air to the tank. The air compressor has a controller which judges the change in pressure inside the tank when the compressor is in a load running state on the basis of a signal delivered from a pressure sensor and effects control such that either one of two operations modes, that is, an intermittent operation mode in which the compressor stands by with the supply of electric power from a motor being cut off and a continuous operation mode in which the compressor stands by in a no-load state with the motor being supplied with electric power, is selected subsequent to a stand-by state. Thus, it is possible to obtain an air compressor having the advantages associated with both a pressure switch type control system and an automatic unloader type control system.

12 Claims, 6 Drawing Sheets

AIR COMPRESSOR HAVING CONTROL MEANS TO SELECT A CONTINUOUS OR INTERMITTENT OPERATION MODE

BACKGROUND OF THE INVENTION

1. Field of the Invention

The present invention relates to an air compressor and, more particularly, to an air compressor having the advantages associated with both types of control system which have heretofore been used to control the pressure of air, that is, the pressure switch type control system and the automatic unloader type control system.

2. Description of the Prior Art

A typical conventional air compressor is arranged as follows. Power which is derived from a driving motor is transmitted to a crankshaft through pulleys and a belt to rotate the crankshaft so as to reciprocate a piston which is received in a cylinder provided at the upper side of a crankcase which defines a main body of the compressor, thus causing the outside air to be sucked into the cylinder from a suction port through a filter, compressed and then delivered in the form of compressed air from a delivery port to an air tank through a delivery pipe which connects the delivery port and the air tank.

Two different types of operation control systems are known which may be used to maintain the pressure of compressed air in a compressor of the type described above at a predetermined value: the continuous operation type (i.e., the automatic unloader type) control system; and the intermittent operation type (i.e., pressure switch type) control system.

These two types of control systems will be briefly explained below with respect to a reciprocating compressor by way of example.

In the continuous operation type control system, when the pressure in the air tank drops to a lower-limit value or less, load running is commenced, whereas, when the pressure inside the air tank reaches an upper-limit value, for example, a suction-side valve is opened to reduce the load on an associated electric motor and in this state the motor is run continuously. In the intermittent operation type control system, the electric motor is started or suspended by the operation of a pressure switch which is arranged so that when the pressure inside the air tank reaches the lower-limit value, the switch is turned on, whereas, when the air tank pressure reaches the upper-limit value, the switch is turned off.

These two control systems have the following features:

(a) The continuous operation type control system

Since the electric motor is continuously run even when the unloader is in an operative state, electric power loss is unavoidable, yet it is possible to supply compressed air promptly when the pressure falls. Accordingly, this type of control system is suitable for use under conditions in which the rate of consumption of compressed air is relatively high.

(b) The intermittent operation type control system

Since the operation of the electric motor is suspended when the pressure reaches the upper-limit value, the electric power loss is relatively small. However, since the motor is started over again from te stationary state when the pressure falls thereafter, it is impossible to promptly supply compressed air when required. Accordingly, this type of control system is suitable for use under conditions in which the consumption rate of air is relatively low, but when the consumption of air increases, the motor must be cyclincally started and suspended at frequent intervals. In such a case, since a large amount of current flows when the motor is started, power consumption increases and the motor readily becomes overheated.

It is not always easy to accurately know the operating conditions under which each individual air compressor is to be employed and to decide which control system should be selected. When the operating conditions change, the air compressor must be replaced or remodeled.

Under these circumstances, certain controllers have been proposed that utilize both of the above-described control systems, such as the "Controller for Compressor" disclosed in Japanese Utility Model Public Disclosure No. 59-14891 (1984).

In this compressor, the no-load running time in the period during which the continuous operation control is carried out and the suspension time in the period during which the intermittent operation control is being effected are respectively detected, and when no-load running continuous for a period of time which is longer than a set time during the continuous operation control, the control mode is automatically switched to the intermittent operation control, whereas, when the suspension time becomes shorter than a set time during the intermittent operation control, the control mode is automatically switched to the continuous operation control. Thus, this prior art has the advantage that it is possible to automatically select an optimal control mode in accordance with the conditions of usage.

However, in the above-described compressor, the switching over of the control mode to an optimal mode is only effected after an unfavorable running situation has actually occurred, for example, when no-load running occurs for a long period of time, or when the motor is restarted after a short suspension time lapses. Therefore, the prior art is not completely free from the above-described disadvantages of the two control systems.

Japanese Patent Laid-Open No. 59-158392 (1984) another prior art apparatus for controlling the operation of an air compressor wherein the fluctuation in the secondary line pressure of the air compressor is constantly measured by means of a pressure sensor and a timer and a condition of pressure fluctuation is judged by means for a computer on the basis of an input signal which is delivered from the pressure sensor, thereby automatically selecting the optimal operation control mode for the air compressor in accordance with the rate of consumption of air in the secondary line from a group consisting of stepless control for normal loaded running, stepwise control including unload running and intermittent control for intermittently suspending a driving electric motor. However, this prior art apparatus also suffers from the disadvantage that the optimal control mode is selected only after an unfavorable running condition has actually occurred, as in the apparatus disclosed in Japanese Utility Model Public Disclosure No. 59-148491 (1984).

SUMMARY OF THE INVENTION

In view of the above-described circumstances, it is a primary object of the present invention to provide an air compressor which is so designed that it is possible to select an optimal control mode accurately and promptly in response to a change in operating conditions.

To this end, the present invention provides an air compressor in which, when the pressure inside a tank for storing compressed air reaches a lower limit, the compressor is brought into a load running state in order to raise the pressure inside the tank, whereas, when the pressure inside the tank reaches an upper limit, the compressor is brought into a stand-by state in order to suspend the supply of compressed air into the tank, and in which it is possible to select one of the following two operation modes: an intermittent operation mode in which the operation of an associated electric motor is intermittently suspended when the compressor is in the stand-by state and a continuous operation mode in which the compressor is brought into a no-load state with the motor kept running. The improvement resides in a detecting means for detecting a change in pressure inside the air tank or a pipe communicating therewith when the compressor is in the load running state, and in a switching means for selecting either the intermittent operation mode or the continuous operation mode on the basis of the result of the detection carried out by the detecting means.

By virtue of the above-described arrangement, since a change in pressure inside the tank is detected when the air compressor is in a load running state, it is possible to judge whether the rate of consumption of air is high or low, and when the pressure inside the tank reaches the upper-limit value, an optimal control mode is selected on the basis of the judgement so that the compressor is allowed to stand by until a subsequent load running operation is commenced.

The above and other objects, features and advantages of the percent invention will become more apparent from the following description of the preferred embodiments thereof taken in conjunction with the accompanying drawings.

BRIEF DESCRIPTION OF THE DRAWINGS

FIGS. 1 to 4 show, in combination, a first embodiment of the air compressor according to present invention, in which:

FIG. 1 is a side view showing the general structure of the first embodiment;

FIG. 2 is a circuit diagram of the control circuit employed in the first embodiment;

FIG. 3 is a flowchart showing a control operation conducted in accordance with the first embodiment; and FIG. 4 is a timing chart showing the operation of the control circuit, together with changes in pressure.

DETAILED DESCRIPTION OF THE PREFERRED EMBODIMENTS

A first embodiment of the present invention will be described hereinunder in detail with reference to FIGS. 1 to 4.

Figure 1:
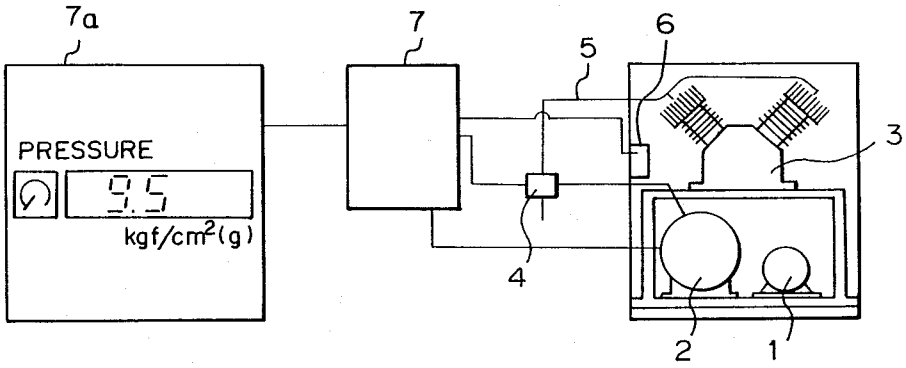

Referring to FIG. 1, which shows the general structure of an air compressor according to the first embodiment, reference numeral 1 denotes an electric motor, 2 an air tank, and 3 a compressor body (a reciprocating compressor being exemplarily shown in the figure).

Between the air tank 2 and the compressor body 3 is provided an unloader pipe line 5 having a three-way electromagnetic valve 4 disposed at an intermediate portion thereof. The unloader pipe line 5 is arranged such that, when the three-way electromagnetic valve 4 is energized, the pressure inside the tank 2 is applied to an unloader (not shown) which actuates a suction valve (not shown) of the compressor body 3 so that the suction valve is forcibly brought into an unloaded (open) position, whereas, when the electromagnetic valve 4 is de-energized, no pressure is applied to the unloader (i.e., the suction valve is not forcibly actuated), thereby allowing the suction valve to perform its normal opening and closing operation.

Reference numeral 6 denotes an electromagnetic contactor which switches on/off a power supply of the motor 1. The contactor 6, together with the electromagnetic valve 4, is connected to a control circuit 7 so that they are controlled by the circuit 7. Further, a display *7a* is connected to the control circuit 7 to display controlled conditions such as a set pressure.

The arrangement of the control circuit 7 will next be described in more detail with reference to FIG. 2.

Figure 2:
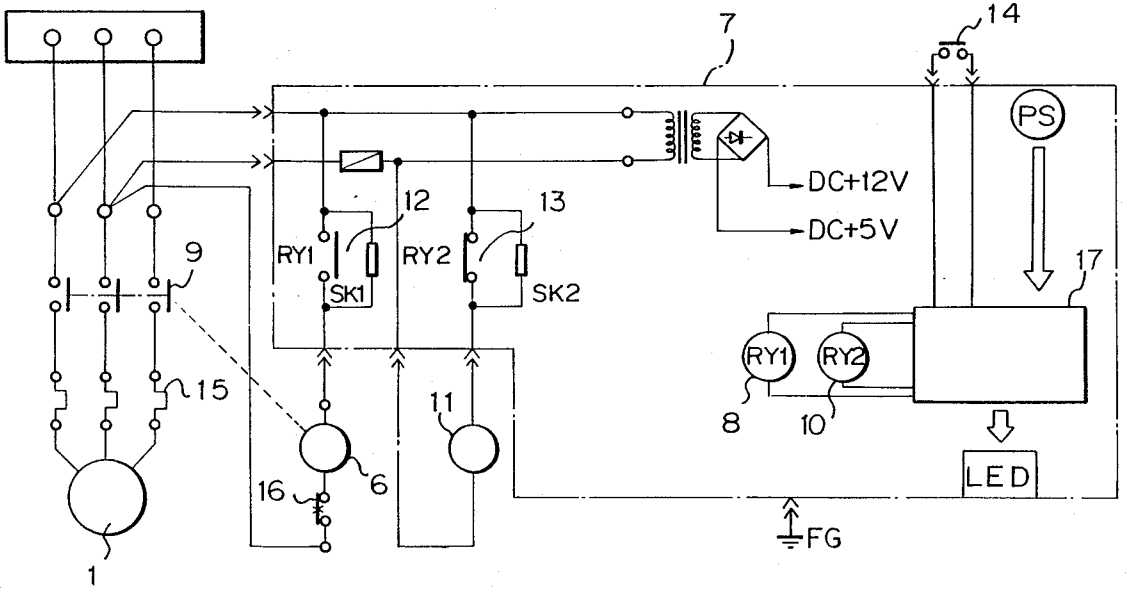

The control circuit 7 comprises circuit elements which are surrounded with the one-dot chain line in FIG. 2. In the figure, reference numeral 8 denotes an exciting coil of a relay RY1 which actuates the electromagnetic contactor 6 so as to open or close contacts 9 provided in a power supply line, 10 an exciting coil of a relay RY2 which actuates an exciting coil 11 of the three-way electromagnetic valve 4, 12 normally-open contacts of the relay RY1, 13 normally-closed contacts of the relay RY2, 14 a push-button switch actuated to turn on/off the power supply of the control circuit 7, 15 a thermal relay for switching on/off the power supply line, and 16 normally-closed contacts of the relay 15.

The exciting coils 8 and 10 are connected to a controller 17 which is arranged to selectively excite the coils 8 and 10 on the basis of a signal output from a pressure sensor PS which detects the level of pressure inside the air tank 2 or an air pipe line (i.e., a part of the machine in which the pressure is equal to that in the tank 2) which is in communication with the tank 2.

Figure 4:
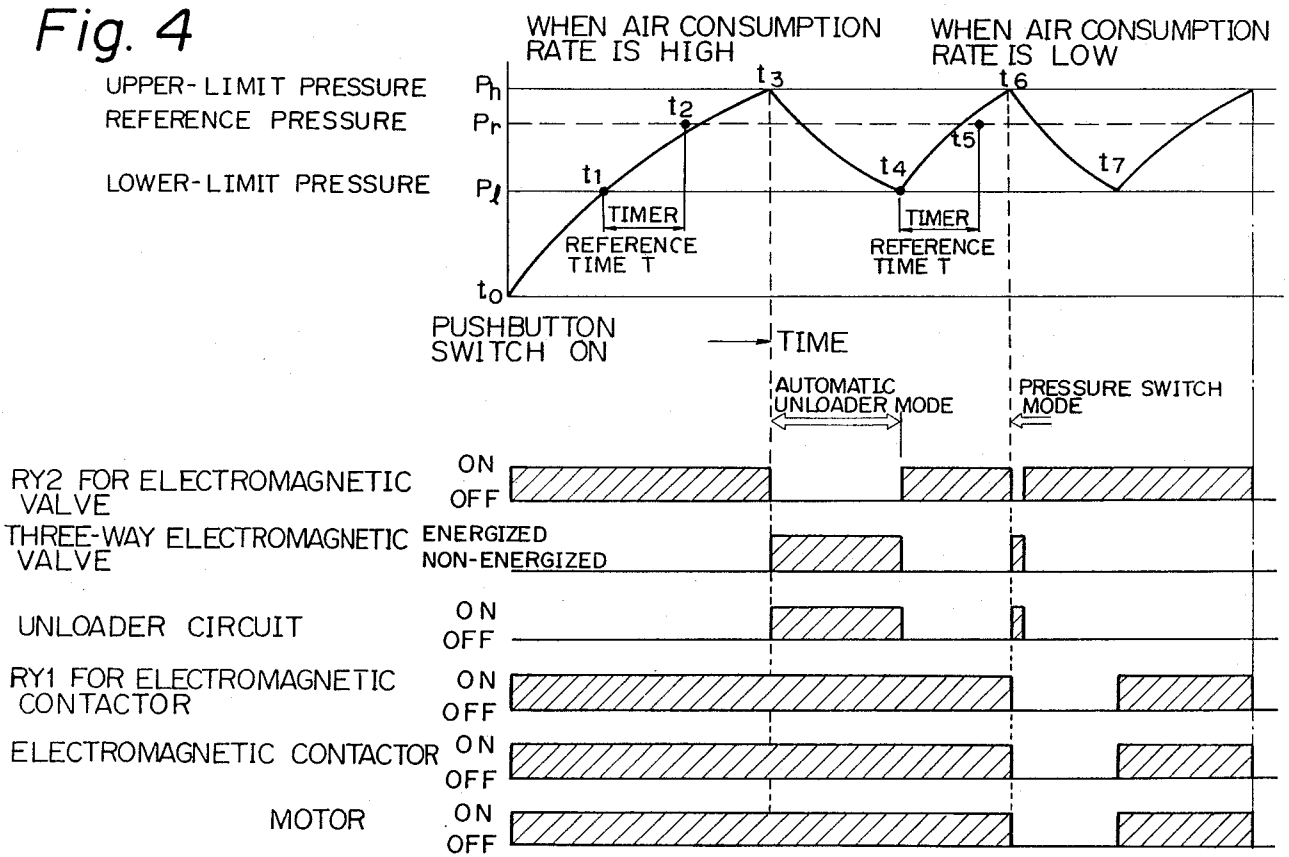

The control effected by the controller 17, together with the operation of the compressor, will next be explained with referenve to FIG. 4.

Before the push-button switch 14 is actuated, the power supply for the motor 1 is off and therefore the compressor is at rest. The tank 2 is placed under atomospheric pressure or the pressure of the air left therein. Since the electromagnetic valve 4 is not energized, the unloader pipe line 5 is open to the atmosphere, and the suction valve of the compressor is in a loaded state (i.e., a state in which a compressing operation may be carried out).

When the push-button switch 14 is actuated, the exciting coil 8 of the relay RY1 is energized to close the contacts 12 and the electromagnetic contactor 6 is activated to close the contacts 9, thus starting the motor 1. At the same time, the exciting coil 10 of the relay RY2 is energized to open the contacts 13. Therefore, the exciting coil 11 of the electromagnetic valve 4 is still left unexcited and the suction valve of the compressor remains in the loaded state. . . . (t0)

Accordingly, as the motor 1 is started, the compressor 3 is run and the pressure inside the tank 3 rises. . . . (t0–t1)

When the pressure exceeds a lower-limit value Pl (e.g., 8 kg/cm2), the pressure sensor PS detects this fact and outputs a signal to the controller 17 so as to cause a timer (not shown) incorporated therein to start measuring time. . . . (t1)

Once a reference time T has elapsed, the pressure PX detected by the pressure sensor PS is read in the controller 17 again, and a judgement is made as to whether or not the pressure at this time is in excess of a predetermined set value, that is, a reference pressure value Pr (e.g., 9 kg/cm2) set between the lower-limit value Pl and an upper-limit value Ph. In the illustrated example, since the measured pressure Px is not in excess of the reference pressure Pr, the controller 17 decides that the operation should be set to the continuous operation mode (the mode in which the compressor stands by with the suction valve kept open and the motor 1 kept running). More specifically, when the compressor has been running for a predetermined period of time and the pressure has not risen to a predetermined set value, it is determined that the air stored in the tank 1 is being consumed at a relatively high rate. Accordingly, under such conditions there is a strong possibility that, even if the pressure reaches the upper-limit value Ph, load running will recommence within a short period of time, and it is therefore decided that the continuous operation mode should be selected, the result of this decision being stored in the memory of the controller 17. It should be noted that the reference pressure value Pr is preferably set as to be as close to the upper-limit value Ph as possible; that is, the reference pressure value Pr should be set at a value at which it is possible for the controller 17 to decide whether the compressor 1 should be run intermittently or continuously and to switch over, for example, the electromagnetic valve 4, on the basis of this decision. . . . (t2)

When it is detected that the pressure has reached the upper-limit value Ph (Ph being set at 9.5 kg/cm2 in the illustrated example), the circuit is controlled so that the compressor 1 stands by with the suction valve kept open. More specifically, the relay RY2 is de-energized to energize the three-way electromagnetic valve 4 to place the pressure inside the tank 1 in communication with the unloader pipe line 5. Consequently, the suction valve (not shown) of the compressor body 3 is forced to open by the pressure of air in the unloader pipe line 5. On the other hand, the exciting coil 8 is left energized so as to maintain the normally-open contacts of the relay RY1 in the closed position. Thus, the motor 1 is run continuously. . . . (t3)

In this way, the compressor is maintained in the stand-by state with the suction valve kept open and the motor 1 kept rotating, and the pressure is gradually lowered as the compressed air is consumed. When the pressure is lowered to the lower-limit value Pr, a signal representative of this fact is output from the pressure sensor PS, and the controller 17 energizes the exciting coil 10 of the relay RY2 to switch over the three-way electromagnetic valve 4 so that no pressure is applied to the unloader pipe line 5 (i.e., the suction valve is released from the forcedly opened position by the tank pressure). As a result, the compressor body 3 is switched over from the stand-by state to the load-running state, and the measuring of the reference time T is started in the same way as occurs after t1. . . . (t4)

As the load running of the compressor starts, the pressure inside the tank 1 gradually rises. When the reference time T has elapsed, the pressure Px inside the tank 1 is compared with the reference value Pr. Since in the case of the illustrated example the measured pressure Px is in excess of the reference pressure Pr, the controller 17 decides that the intermittent operation mode (i.e., the mode in which the compressor body 3 stands by with the operation of the motor 1 suspended) should be selected. More specifically, when the pressure inside the tank 1 exceeds a predetermined set value as a result of the operation of the compressor for a predetermined period of time, it is determined that the rate of consumption of the air stored in the tank 1 is relatively low. Accordingly, under such conditions the interval of time from the instant the pressure reaches the upper-limit value Ph until the pressure lowers and load running is recommended is relatively long, and it is therefore decided that the intermittent operation mode should be selected. . . . (t5)

When the upper-limit pressure Ph is reached, the circuit is controlled so that operation of motor 1 is suspended. More specifically, the exciting coil 8 of the relay RY1 is de-energized and the electromagnetic contactor 6 is thereby de-energized to open the contacts 9, thus suspending the operation of the motor 1. . . . (t6)

Thus, the compressor is maintained in the stand-by state with the operation of the motor 1 suspended. When the pressure inside the tank 2 is lowered to the lower-limit value Pl as the air is consumed, the exciting coil 8 of the relay RY1 is energized so as to start the motor 1. . . . (t7)

Thereafter, a control operation which is similar to tht carried out from t1 to t7 is repeated.

Figure 3:
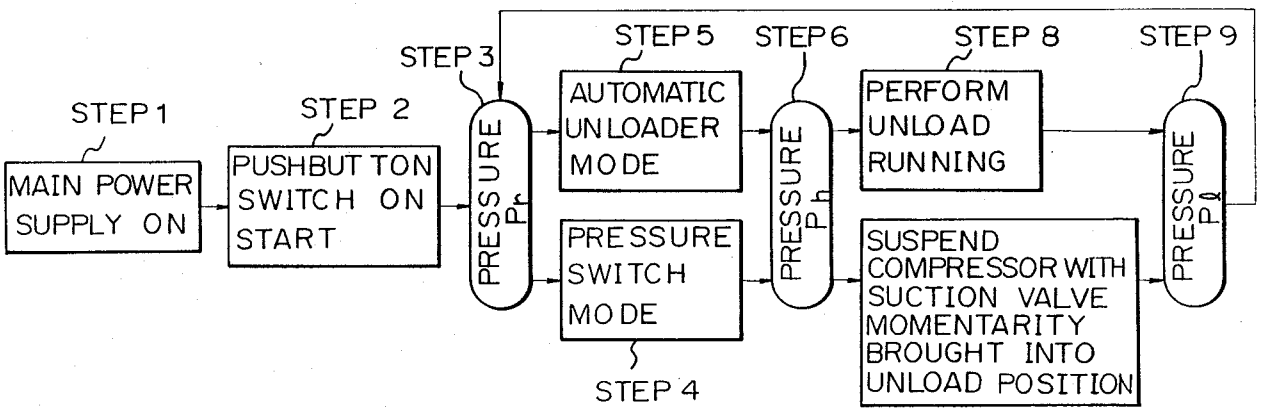

FIG. 3 is a flowchart illustrative of the above-described control operation.

The above-described control operation will now be briefly explained again with reference to the illustrated flowchart.

The main power supply is first turned on (Step 1), and the push-button switch 14 is then actuated (Step 2). Consequently, the compressor starts running, and the pressure inside the tank rises. When the pressure reaches the lower-limit value Pl (8 kg/cm2), the measuring of the reference time T is started. When the time T has elasped, the pressure measured is compared with the reference pressure Pr (9 kg/cm2) (Step 3). If the measured pressure is in excess of the reference pressure Pr, it is decided (Step 4) that the pressure switch (intermittent operation) mode should be selected, whereas, if the measured pressure is not in excess of the reference pressure Pr, it is decided (Step 5) that the automatic unloader (continuous operation) mode should be selected.

When the pressure reaches the upper-limit value Ph (Step 6), if it has been decided that the pressure switch mode should be selected, the suction valve is momentarily brought into an unloaded position and the operation of the motor 1 is suspended (Step 7), whereas, if it has been decided that the automatic unloader mode should be selected, unloaded running is carried out with the motor 1 kept running (Step 8). It should be noted that, since the suction valve is momentarily brought into an unloaded position when the motor 1 is de-energized in Step 7, the load on the compressor body 3 is reduced after the power supply is turned off so as to allow the inertial rotation of the motor 1 to continue, thus enabling cooling of the motor 1 to be effected by a fan (not shown) which is associated with the motor 1. When it is detected that the pressure inside the tank has become lower than the lower-limit value Pl, load running is recommended (Step 9), and thereafter, the above-described operations carried out in Steps 3 to 9 are repeated.

The way in which an optimal operation mode is selected by making a decision on the basis of a pressure change during load running is not necessarily limited to the method employed in the above-described embodiment but it is also possible to adopt the following methods:

(a) A value which is obtained by differentiating pressure data obtained from the pressure sensor over a certain period of time (i.e., the inclination of the pressure rise curve) is compared with a reference value for said period, and when the measured value is in excess of the reference value, the intermittent operation mode is selected, whereas, when the former is not in excess of the latter, the continuous operation mode is selected.

(b) A period of time from the moment when instant load running is commenced until a predetermined pressure has been reached is measured, and when the measured time is in excess of a predetermined period of time, the continuous operation mode is selected, whereas, when the former is not in excess of the latter, the intermittent operation mode is selected.

The control system according to the present invention may be applied not only to the reciprocating compressor exemplarily shown in the above-described embodiment but also to positive-displacement compressors, for example, an oil-cooled compressor as disclosed in Japanese Patent Public Disclosure No. 56-580 (1981) by the applicant of the present invention, or a scroll type compressor as disclosed in Japanese Patent Public Disclosure No. 60-24708 (1985). When the control system according to the present invention is applied to positive-displacement compressors, the above-described unloaded running should be understood to be a running state wherein a volume regulating valve which is provided at the suction side of a compressor is throttled to reduce the quantity of sucked air.

The specific structure of the control circuit is not necessarily limited to that shown in the above-described embodiment and it is possible to emply other types of circuits which are capable of performing an equivalent operation.

Although in the above-described embodiment the suction valve is momentarily brought into an unloaded position when the intermittent operation mode is commenced in order to extend the period of time during which the inertial rotation of the motor continues, it is also possible to extend the duration of inertial rotation of the motor so as to promote cooling of both the motor and the compressor by switching the electromagnetic valve to place the suction valve in an unloaded position throughout the intermittent operation period and by returning the valve to the previous position when a subsequent load running is commenced. Depending upon the particular operating conditions (i.e., when the rate of consumption of compressed air is exceedingly low), the interval of time from the instant the operation of the motor is suspended until it is restarted may be relatively long. In such a case, therefore, it is possible to omit the control operation by means of which the suction valve is set in an unloaded position when the operation of the motor is suspended. For the purpose of facilitating the understanding of these alternative matters, a second embodiment of the present invention will next be described with reference to FIGS. 5 and 6.

Since the differentiating feature of the second embodiment resides in the control of the suction valve which is effected when the intermittent operation mode is selected as an optimal operation mode in the stand-by state, it is assumed for the convenience of explanation that the operating conditions are such that the rate of consumption of compressed air is relatively low and the intermittent operation mode is therefore continuously selected. This embodiment operates in the same manner as the first embodiment except for the above feature and the constituent elements of the second embodiment may be the same as those employed in the first embodiment and therefore, a detailed description thereof is omitted.

Conventional air compressors that adopt the intermittent operation type control system are provided with cooling fans which are rotated by a motor to cool the motor and the compressor body, respectively. In such a conventional air compressor, when the motor is de-energized, the motor is supposed to continue rotating under the action of inertia, but the motor actually comes to rest immediately because the compressor is in a loaded state. Therefore, the self-cooling action provided by the rotation of the motor becomes unavailable. For this reason, if the motor is repeatedly started and stopped at frequent intervals, the temperature of the coil of the motor rises extraordinarily. Accordingly, conventional air compressors are able to be used only under conditions in which the motor is cyclically stopped and started less than about in 15 times per hour.

As has been described above, the first embodiment of the present invention, the continuous operation mode is automatically selected when load running is repeated at short intervals; the second embodiment is directed to enhance the self-cooling action in the air compressor when the intermittent operation mode is selected to thereby overcome the above-described problems of the prior art.

To this end, in this embodiment the unloader mechanism is operated in a manner in which when the pressure inside the air tank reaches a set pressure while in the intermittent operation mode and the motor is consequently de-energized to suspend the operation of the compressor, the motor is allowed to continue rotating under the action of inertia even after the supply of electric power to the motor has been cut off.

Accordingly, when the air pressure inside the air tank reaches a set pressure, the motor is de-energized and a control mechanism activates the unloader mechanism so that the motor can continue to rotate under the action of inertia. Thus, when the set pressure is reached, the suction valve is opened to commence unloaded running of the compressor and, at the same time, the fan is rotated so as to prevent any excessive rise in temperature of the coil of the motor.

Figure 5:
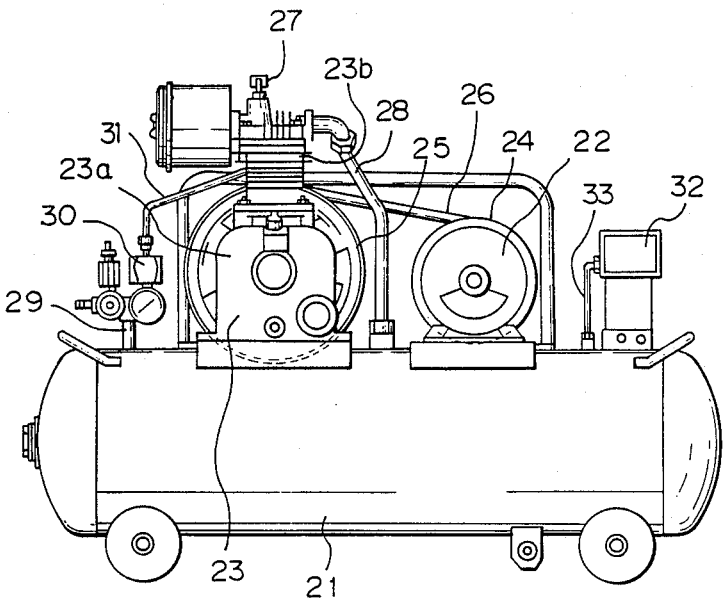
FIG. 5 schematically shows the structure of a second embodiment of the air compressor according to the present invention; and FIG. is a timing chart showing a control operation conducted in accordance with the second embodiment.

Referring to FIG. 5, reference numeral 21 denotes an air tank for storing compressed air, and a motor 22 and an air compressor body 23 are secured to the upper side of the air tank 21. The air compressor body 23 comprises a main body **23*a*, a cylinder 23*b* provided at the upper side of the body 23*a*, a crankshaft provided in the body 23*a*, and a piston slidably provided in the cylinder 23*b*** and connected to the crankshaft through a connecting rod.

The air compressor body 23 and the motor 22 are connected together by a belt 26 through a pulley 24 which is secured to the rotary shaft of the motor 22 and a pulley 25 which is secured to the crankshaft of the air compressor body 23. Each of the pulleys 24 and 25 is provided with a plurality of blades so that the pulley functions as a cooling fan.

An unloader mechanism 27 is provided at the air suction side of the cylinder head of the air compressor body 23. An air delivery port which is provided in the cylinder head communicates with the air tank 21 through a pipe 28.

An electromagnetic valve 30 is secured to the upper side of the air tank 21 through a pipe 29, the valve 30 being connected to the unloader mechanism 27 through a pipe 31.

Further, a controller 32 which is connected to a power supply and a sequence circuit (not shown) is mounted on the upper side of the air tank 21. The controller 32 has a pressure sensor (not shown).and is connected to the air tank 21 through a pipe 33. The controller 32 is operatively electrically connected with the electromagnetic valve 30.

The following is a description of the operation of the air compressor described above.

As the motor 22 is started, the crankshaft is rotated through the pulleys 24, 25 and the belt 26, and the piston disposed inside the cylinder **23*b* is thereby reciprocated vertically through the connecting rod, thus causing the air sucked into the cylinder 23*b* to be compressed, delivered from the delivery port through the pipe 28 and stored in the air tank 21**.

Figure 6:
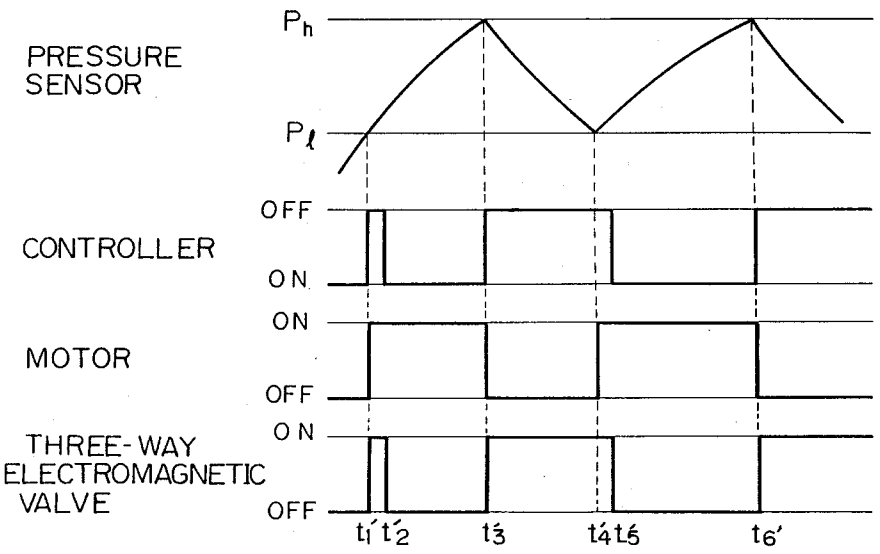

As shown in FIG. 6, when the power supply is turned on, the sequence circuit activates the motor 22 to be energized (ON), and the compressor body 23 is thus activated. When the pressure sensor detects that the pressure inside the air tank 21 has reached the lower-pressure value Pl at the time t'1, the controller 32 is momentarily (t'1 to t'2) turned off in response to a signal output from the pressure sensor. Consequently, the electromagnetic valve 30 is momentarily (t'1 to t'2) turned on so as to open, thereby allowing the compressed air in the air tank 21 to actuate the unloader mechanism 27 so as to maintain the suction valve of the compressor body 23 in an open position, and thud bringing the compressor body 23 into an unloaded running state. Accordingly, the load on the motor 22 is at this time reduced. At the time t'2, the controller 32 turns on and the electromagnetic valve 30 is closed. Consequently, the unloader mechanism 27 returns to its previous state and the suction valve is brought into a load running position, resulting in a rise in the pressure inside the air tank 21.

At the time t'3, the pressure inside the air tank 21 reaches a predetermined upper-limit value Ph. It should be noted that, prior to the time t'3, the intermittent operation mode has already been selected by the controller 32 as in of the first embodiment described above. The pressure Ph is detected by the pressure sensor, and the controller 32 is turned off in response to a signal output from the pressure sensor. Consequently, the electromagnetic valve 30 is turned on to activate the unloader mechanism 27 so as to force the suction valve to open. At the same time, the supply of electric power to the motor 22 is suspended. Accordingly, at this time, the motor 22 is de-energized, while the compressor body 23 is brought into an unloaded state, and the load on the motor 22 is reduced, so that the motor 22 continues rotating for a certain period of time under the action of inertia. Thus, the motor 22 and the compressor body 23 are cooled by the respective fans 24 and 25.

It should be noted that the motor 22 continues rotating during the period from the time the motor 22 is turned on until the time t'3 and the pulleys 24 and 25, that is, the fans, rotate together with the motor 22 so as to cool the motor 22, thus suppressing the rise in temperature of the coil of the motor 22.

At the time t'4, the pressure inside the air tank drops to the lower-limit value Pl as a result of consumption of the compressed air stored in the air tank 1. Although during the period from t'3 to t'4 the supply of electric power to the motor 22 is kept suspended, since the unloader mechanism 27 keeps the suction valve open, the compressor body 23 is placed in an unloaded state with the operation of the motor 22 kept suspended.

When the pressure inside the air tank 21 drops to the lower-limit value Pl at the time t'4, the pressure P is detected by the pressure sensor, and the supply of electric power to the motor 22 is started in response to a signal output from the pressure sensor, but the controller 32 allows the electromagnetic valve 30 to continue to be open one more second (from t'4 to t'5) and turns if off at the time t'5. Accordingly, during the period from t'4 to t'5, the compressor body 23 is in an unloaded state with the motor 22 kept running. Therefore, the load on the motor 22 is reduced and the generation of heat in the coil of the motor 22 is also reduced. After one second has elapsed from the time t'4, i.e., at the time t'5, the controller 32 turns on to cause the electromagnetic valve 30 to turn off, thus commencing load running. As a result, the pressure inside the air tank 21 gradually rises and reaches the upper-limit value Ph at the time t'6. The pressure Ph is detected by the pressure sensor, and the controller 32 is turned off in response to a signal output from the pressure sensor. Consequently, the electromagnetic valve 30 is turned on, while the motor 22 is turned off, thus bringing the compressor body 23 into an unloaded state wherein the operation of the motor 22 is kept suspended. If the compressed air stored in the air tank 21 is consumed during this unloaded running period, the pressure inside the tank 21 is lowered.

During the period from t'4 to t'6, the fans are continuously rotated together with the motor 22 and therefore the motor 22 is cooled by the operation of the associated fan.

Thus, according to this embodiment, when the motor 22 is in an operative state, it is cooled by the fan and further, at the time of starting and suspending the operation of the motor 22, unloaded running is conducted so as to reduce the load on the motor 22. Accordingly, the generation of heat at the time of starting the motor 21 is suppressed, and the motor 22 is cooled by the fan even after the power supply to the motor 22 has been suspended. Therefore, it is possible to prevent any excessive rise in temperature of the coil of the motor 22.

A temperature sensor may be provided in the vicinity of the coil of the motor 22 to measure the temperature of the coil and unloaded running is conducted when the pressure inside the air tank 21 reaches a set value and the temperature of the coil of the motor 22 exceeds a set value.

Although in this embodiment both the pulleys 24 and 25 have a plurality of blades so as to function as cooling fans, it is only necessary to provide a plurality of blades on either one of them if the air tank 21, the compressor body 23, etc. are all placed in a soundproof box, and cooling fans may be provided separately from the pulleys 24, 25. It is not always necessary to provide a plurality of blades on the pulleys 24, 25, and a similar cooling effect is obtained by the rotation of the rotor itself of the motor 22.

Although in this embodiment the present invention is applied to a reciprocating compressor, the invention may also be applied to positive-displacement compressors such as screw-type and scroll-type compressors, and in such cases the above-described unloaded running refers to a running state wherein a volume regulating valve provided at the suction side of a compressor is throttled to reduce the quantity of sucked air to a value smaller than that during load running.

As will be clear from the foregoing description, according to the present invention, either the intermittent operation mode or the continuous operation mode is selected subsequent to stand-by in accordance with the change in pressure at the time when the compressor commences load running as a result of the pressure inside of the air tank dropping. Thus, the presnt invention offers the following advantages:

(a) When the rate of consumption of compressed air is relatively high, the compressor stands by in an unloaded state wherein the compressor is able to immediately commence load running, thereby enabling the tank to be promptly supplied with compressed air when required, whereas when the consumption rate of air is relatively low, the compressor stands by with the operation of the motor being suspended. Thus, it is possible to prevent wasteful consumption of electric power which would otherwise be unavoidable when unloaded running continues for a long period of time.

(b) Since the compressor is arranged to stand by in an unloaded state when the rate of consumption of compressed air is relatively high, the number of times the compressor needs to be started is minimized. Therefore, it is possible to minimize the number of times a large amount of current is supplied when the compressor is started and it is also possible to suppress the generation of heat resulting from the flow of a large amount of current and to inhibit wear of the parts of the motor.

(c) When he intermittent operation mode is selected, the unloader is activated at the time of starting and suspending the motor so that the motor is unloaded. Therefore, it is possible not only to cool the motor by means of the fan when the motor is in an operative state but it is also possible to suppress the generation of theat at the time of starting the motor. In addition, since the motor is cooled by the fan even after the supply of electric power to the motor has been suspended, it is possible to prevent an excessive rise in temperature of the coil of the motor and ensure a safe running of the compressor.

Although the present invention has been described with specific terms, it should be noted here that the embodiments are not necessarily limitative of the invention and various changes and modifications may be imparted thereto without departing from the scope of the invention which is limited solely by the appended claims.

What is claimed is:

1. An air compressor comprising:

an air tank for storing compressed air;

a compressor body drivable to compress air, said compressor body connected to said air tank for supplying compressed air to said tank when the compressor is driven;

a controllable drive means operatively connected to said compressor body for driving said compressor body when the drive means is controlled to be operated;

pressure detecting means disposed in the compressor for detecting the pressure in said air tank and issuing signals corresponding to the detected pressure;

a controllable unloader means operatively connected to said compressor body for selectively rendering the compressor in a no-load state and in a loaded state; and control means operatively connected to said drive means, said pressure detecting means and said unloader means for receiving the signals from said pressure detecting means, for controlling said drive means to operate and said unloader means to render said compressor in said loaded state to place the compressor in a load running state when the pressure in said air tank reaches a predetermined lower-limit value, for controlling said drive means and said unloader means to place the compressor in a stand-by state when pressure in said air tank reaches a predetermined upper-limit value, for determining on the basis of at least one of the signals a change in the pressure in said air tank when the compressor is in said load running state, and for selectively controlling said unloader and said drive means to place the compressor in either of two operating modes based on the determination, one of said operating modes being an intermittent operation mode in which the drive means is not operated when the compressor is placed in said stand-by state, the other of said operating modes being a continuous operation mode in which the unloader means renders the compressor in said no-load state while the drive means is operated when the compressor is placed in said stand-by state.

2. An air compressor is claimed in claim 1, wherein said control means includes a timer for measuring a predetermined period of time after the compressor has been placed in said load running state, and said control means makes the determination by determining whether the pressure detected by said pressure detecting means at the lapse of said predetermined period of time exceeds a predetermined value.

3. An air compressor as claimed in claim 1, wherein said control means calculates the rate in which pressure rises in said air tank, and makes the determination by determining whether the calculated rate exceeds a predetermined value.

4. An air compressor as claimed in claim 1, wherein said control means includes a timer means for measuring the time elapsing one the compressor has been placed in said load running state, and makes the determination by determining whether the time measured until the pressure in said air tank reaches a predetermined value exceeds a predetermined reference time period.

5. An air compressor as claimed in claim 1, wherein said controller, when selectively controlling said unloader and said drive means to place the compressor in said intermittent operation mode, controls said unloader to render the compressor in said no-load state when in said stand-by state.

6. An air compressor as claimed in claim 5, wherein said control means controls said unloader means to render the compressor in said no-load state throughout the entire time the compressor is in said stand-by state while in said intermittent operation mode.

7. An air compressor as claimed in claim 5, wherein said control means controls said unloader means to render the compressor in said no-load state for only a predetermined amount of time at the initiation of said stand-by state while the compressor is in said intermittent operation mode.

8. An air compressor as claimed in claim 1, wherein said control means controls said unloader means to render the compressor in an unloaded state for a predetermined period of time just prior to said control means controlling said drive means and said unloader means to place the compressor in said load running state.

9. An air compressor as claimed in claim 2, wherein said controller, when selectively controlling said unloader means and said drive means to place the compressor in said intermittent operation mode, controls said unloader means to render the compressor in said no-load state when in said stand-by state.

10. An air compressor as claimed in claim 9, wherein said control means controls said unloader means to render the compressor in said no-load state throughout the entire time the compressor is in said stand-by state while in said intermittent operation mode.

11. An air compressor as claimed in claim 9, wherein said control means controls said unloader means to render the compressor in said no-load state for only a predetermined amount of time at the initiation of said stand-by state while the compressor is in said intermittent operation mode.

12. An air compressor as claimed in claim 2, wherein said control means said unloader means to render the compressor in an unloaded state for a predetermined period of time just prior to said control means controlling said drive means and said unloader means to place the compressor in said load running state.

* * * * *